United States Patent [19]

Schuierer

[11] 3,988,109

[45] Oct. 26, 1976

[54] PROCESS OF DYEING AND FINISHING TEXTILE MATERIAL

[75] Inventor: Manfred Schuierer, Zell in Odenwald, Germany

[73] Assignee: Bruckner Apparatebau GmbH, Erbach, Germany

[22] Filed: Feb. 21, 1975

[21] Appl. No.: 551,741

[30] Foreign Application Priority Data

Feb. 28, 1974 Germany ..... 2409473
July 12, 1974 Germany ..... 2433662

[52] U.S. Cl. ..... 8/94 R; 8/172 R; 8/173; 8/175

[51] Int. Cl.[2] ..... C09B 67/00; D06P 1/64

[58] Field of Search ..... 8/175, 94

[56] References Cited

FOREIGN PATENTS OR APPLICATIONS

| | | |
|---|---|---|
| 2,006,021 | 12/1969 | France |
| 2,215,297 | 10/1973 | Germany |
| 1,040,501 | 10/1958 | Germany |
| 1,918,340 | 10/1969 | Germany |
| 692,500 | 10/1970 | South Africa |
| 792,210 | 3/1958 | United Kingdom |

*Primary Examiner*—Joseph L. Schofer
*Assistant Examiner*—A. L. Clingman
*Attorney, Agent, or Firm*—Learman & McCulloch

[57] ABSTRACT

A process for the dyeing or finishing of textile material of natural or synthetic fibres comprises applying to the material a liquor containing the dye or fixing chemical followed by subjecting the material, at substantially room temperature, to air enriched with halogenated hydrocarbon having a boiling point lower than 85° C.

18 Claims, No Drawings

PROCESS OF DYEING AND FINISHING TEXTILE MATERIAL

The invention relates to a process for dyeing and finishing textile material of synthetic or native fibres, in particular of polyester, in which a solution or dispersion of a dye or an application chemical is applied to the textile material and for the purpose of fixing the dye or the application chemical a halogenated hydrocarbon (halogenated derivative of methane or halogenated derivative of ethane and ethylene in which only two H atoms are substituted by halogens) having a boiling point below 85° C is allowed to act on the textile material.

In a known process for dyeing textile material of synthetic fibres (DT-OS No. 2,215,297) the textile material provided with the dye solution is wound on a perforated cylinder, evacuated in an autoclave and then treated with a superheated liquid fixing agent, for example with water at 110° to 135° C. The disadvantage with this process is that the liquid fixing agent rinses away a large part of the dye applied to the textile material and this results in a danger of irregular dyeing. Another disadvantage is the considerable energy consumption of this process.

In another known process (German Pat. No. 1,040,501) the textile material is conducted through an aqueous solution of the dye and then heated until little or none of the water absorbed by the fibres remains. The textile material is then exposed to the saturated vapour of halogenated hydrocarbons. A particular disadvantage of this process is that operating with saturated vapour requires a working temperature corresponding to the boiling point of the solvent (thus for example 87° C in the case of trichloroethylene) or, if the operation is to be carried out at room temperature, the provision of a vacuum.

The objective of the invention is the provision of a process which avoids these defects and which permits the fixing of dyes and application chemicals at room temperature.

According to the invention this objective is achieved in that the textile material provided with the solution or dispersion of the dye or application chemical is exposed to the action of air enriched with the halogenated hydrocarbon at a temperature of at the most about 30° C, and preferably at room temperature.

If, in the known process referred to above (according to German Pat. No. 1,040,501), the saturated vapour of halogenated hydrocarbons is used, the solvents condense because of the temperature difference on the fibres and produce a swelling, the diffusion of the dye or the application chemical into the fibres thereby taking place. It has surprisingly now been found that the halogenated hydrocarbons, when they are dissolved in an inert gas such as air, also diffuse into the textile fibres without previously condensing thereon. Whereas in the condensation the temperature difference between the textile material and saturated vapour is decisive as regards the amount of deposited halogenated hydrocarbon, the absorption of the halogenated hydrocarbons by the fibres which occurs when using air enriched with halogenated hydrocarbons depends essentially on the nature of the fibres.

The process according to the invention thus has substantial advantages. It permits operating at room temperature under atmospheric pressure (although obviously it is also possible to work with excess pressure).

This enables the use of a simple apparatus which does not involve any sealing or isolation problems. Another advantage is the considerable saving in energy.

The process according to the invention may be employed advantageously both with synthetic fibres, such as polyester, polyamide, polyacrylonitryl, triacetate and the like, and with wool, cellulosic natural fibres and cellulosic regenerated fibres.

Suitable dyes are in particular dispersion dyes, basic dyes, acid dyes, metal complex dyes, reactive dyes and direct dyes.

Application chemicals may for example be chemicals for flame-resistant finishing, such as highly brominated hydrocarbons and phosphoric acid esters, as well as chemicals for obtaining antistatic effects and for obtaining hydrophilic fibres.

The air enriched with the hydrocarbon is advantageously continuously circulated. This is particularly advisable when the textile material is in the form of a roll.

The process according to the invention may be carried out advantageously in such manner that the textile material provided with the solution or a dispersion of a dye or an application chemical is subjected immediately without intermediate drying to the action of the air enriched with halogenated hydrocarbon. There are however some processes in which, after the application of the liquor, a preliminary drying is effected before fixation.

Methylene chloride is preferably used as halogenated hydrocarbon.

The enrichment of the air with halogenated hydrocarbon may be effected by conducting the air through liquid halogenated hydrocarbon.

The effect of the air enriched with the halogenated hydrocarbon may be further promoted by first subjecting the textile material to a vacuum and only then subjecting it to the action of the air enriched with the halogenated hydrocarbon.

After the action of the air enriched with the halogenated hydrocarbon the textile material is advantageously subjected to the action of steam or hot water to remove the halogenated hydrocarbon still present therein.

When dyeing with ionic dyes it has proved convenient to select dyes which have a high solubility in the halogenated hydrocarbon used.

It may be advantageous to leave the textile material for a certain time after the application of the solution or dispersion of the dye or chemical (to homogenize the liquor applied) before subjecting it to the action of the air enriched with halogenated hydrocarbon.

It is of course also possible to dye with the process according to the invention textile material containing cellulosic fibres or wool apart from synthetic fibres. In this case, the solution or dispersion is also provided with the dyes or other chemicals intended for application to the cellulosic fibres or wool.

The solution or dispersion of the dye or the application chemical may be in water or in an organic solvent (for example perchloroethylene, benzine, alcohol).

The invention will be explained in detail by means of the following example.

Textile material of textured polyester filaments is impregnated with aqueous dye liquor. The liquor contains 25 g/l Terasil red G. After impregnation the material is wound on a perforated cylinder. This roll of material is introduced into an air circuit enriched with methylene chloride.

During a treatment time of 4 hours the air is passed through the textile material and simultaneously brought into exchange relationship with methylene chloride so that the enrichment of the air is maintained. After the set time the air circulation is stopped, the material treated with water and as usual finished by rinsing and drying.

Advantageously, a polar solvent exerting a swelling action on the fibres may be added to the solution or dispersion of the dye or application chemical.

When using the process for dyeing and finishing textile material of wool and polyamide a polar solvent is preferably used from the group of alcohols, in particular benzyl and n-butyl alcohol.

When using the process for dyeing and finishing textile material of polyacryl the polar solvent advantageously employed is ethylene carbonate, propylene carbonate, dimethyl formamide or dimethyl acetamide.

What is claimed is:

1. A process of fixing a dye or finishing substance applied to textile material of synthetic or natural fibres, said process comprising applying to such material an aqueous solution or dispersion of said substance; and subsequently exposing said material to air enriched with halogenated hydrocarbon having a boiling point below 85° C, the exposure to the enriched air occuring at a temperature not exceeding 30° C and prior to drying of said material.

2. The process according to claim 1 wherein the enriched air is continuously circulated.

3. The process according to claim 1 wherein the exposure of said material to the enriched air occurs immediately following the application of said liquor to said material.

4. The process according to claim 1 wherein the exposure of said material to the enriched air occurs a sufficient time after the application of said liquor to said material to permit homogenization of said liquor.

5. The process according to claim 1 wherein said halogenated hydrocarbon is a halogenated derivative of methane or a halogenated derivative of ethane and ethylene.

6. The process according to claim 1 wherein said halogenated hydrocarbon is one in which only two H atoms are substituted by halogens.

7. The process according to claim 1 wherein said halogenated hydrocarbon comprises methylene chloride.

8. The process according to claim 1 wherein said air is enriched by passing it through liquid halogenated hydrocarbon.

9. The process according to claim 8 wherein the air also is enriched with water.

10. The process according to claim 1 wherein the material to which said liquor has been applied is subjected to vacuum prior to its exposure to the enriched air.

11. The process according to claim 1 including removing halogenated hydrocarbon from said material by subjecting the latter to steam or hot water following the exposure of said material to the enriched air.

12. The process according to claim 1 wherein said liquor contains an ionic dye having a high solubility in said halogenated hydrocarbon.

13. The process according to claim 1 wherein said material contains cellulosic fibres.

14. The process according to claim 1 wherein said material contains wool fibres.

15. The process according to claim 1 wherein said liquor contains a polar solvent to exert a swelling effect on the fibres of said material.

16. The process according to claim 15 wherein said polar solvent is selected from benzyl and n-butyl alcohols.

17. The process according to claim 15 wherein said polar solvent is selected from the class comprising ethylene carbonate, propylene carbonate, dimethyl formamide, and dimethyl acetamide.

18. A process of fixing a dye or finishing substance applied to textile material comprising polyester fibres, said process comprising applying to such material an aqueous solution or dispersion of said substance and subsequently exposing said material to air enriched with methylene chloride and having a temperature not exceeding 30° C.

* * * * *